United States Patent [19]

LeBlanc et al.

[11] Patent Number: 4,615,323

[45] Date of Patent: Oct. 7, 1986

[54] PUMP/NOZZLE UNIT FOR FUEL INJECTION IN INTERNAL COMBUSTION ENGINES

[75] Inventors: Jean LeBlanc, Lyons; Francois Rossignol, Mornant, both of France

[73] Assignee: Robert Bosch GmbH, Stuttgart, Fed. Rep. of Germany

[21] Appl. No.: 721,113

[22] PCT Filed: Jul. 17, 1984

[86] PCT No.: PCT/DE84/00147

§ 371 Date: Mar. 29, 1985

§ 102(e) Date: Mar. 29, 1985

[87] PCT Pub. No.: WO85/00638

PCT Pub. Date: Feb. 14, 1985

[30] Foreign Application Priority Data

Jul. 29, 1983 [DE] Fed. Rep. of Germany ..... 3327399

[51] Int. Cl.[4] ..... F02M 39/00

[52] U.S. Cl. ..... 123/509; 123/508; 123/470

[58] Field of Search ..... 123/508, 509, 276, 470, 123/471, 472; 239/600; 417/499, DIG. 1, 275

[56] References Cited

U.S. PATENT DOCUMENTS

| | | | |
|---|---|---|---|
| 1,863,232 | 6/1932 | Woolson | 123/509 |
| 2,354,403 | 7/1944 | Reggio | 123/509 |
| 2,793,078 | 5/1957 | Brill | 123/509 |
| 3,845,748 | 11/1974 | Eisenberg | 123/470 |
| 4,522,182 | 6/1985 | Mowbray | 123/509 |

FOREIGN PATENT DOCUMENTS

| | | | |
|---|---|---|---|
| 768513 | 8/1934 | France | 123/509 |
| 0204962 | 11/1983 | Japan | 123/508 |
| 42814 | 3/1938 | Netherlands | 123/508 |

*Primary Examiner*—Carl Stuart Miller
*Attorney, Agent, or Firm*—Edwin E. Greigg

[57] ABSTRACT

A pump/nozzle unit having an injection nozzle installed at at least approximately right angles to the longitudinal axis (A) on the pump housing of the piston injeciton pump. The injection pump is supported with a support face, which embodies its most extreme axial extension, on a support bearing located on the cylinder head of the engine. The support face is embodied by an outwardly pointing end face of a counterpart piston which is inserted into the pump cylinder in an extension of the longitudinal axis (A) and, with an inner end face, seals off the pump work chamber in a pressure-tight manner. As a result, the pumping forces resulting from the fuel which is placed under pressure in the pump work chamber are kept from affecting the pump housing and intercepted at a location on the cylinder head which is remote from a receiving bore for the injection nozzle.

8 Claims, 2 Drawing Figures

PUMP/NOZZLE UNIT FOR FUEL INJECTION IN INTERNAL COMBUSTION ENGINES

STATE OF THE ART

The invention is directed to improvements in a pump-/nozzle unit for use in internal combustion engine fuel injection systems. A pump/nozzle unit of this kind is already known (German laid-open patent application De-OS 32 26 238), in which the piston injection pump and injection nozzle are combined in a common pump housing to make a structrual unit installed on the cylinder head of the engine. Differing from the otherwise conventional coaxial, i.e., in-line, structure, in the known pump/nozzle unit the longitudinal axis of the pump piston, which is also designated as the line of action of the injection pump, and the longitudinal axis of the injection nozzle are preferably at right angles to one another. This provision was made in order to attain a more compact structure and in order to intercept the pumping forces at a cylinder head location remote from the injection nozzle receiving bore. This has the advantage that the injection nozzle diameter and structural shape, and the thicknesses of the cylinder head wall surrounding this nozzle, can be optimally designed. This is possible because the very strong pumping forces, which are on the order of magnitude of 2000N, are intercepted at a cylinder head location the dimensions of which can be made appropriately thick. To this end, the pump/nozzle unit described in FIG. 2 of the above German laid-open patent application is supported with a support face, on its end remote from the camshaft, on a corresponding face of the cylinder head. The injection nozzle disposed laterally at an angle with respect to the longitudinal axis of the pump piston is received by a receiving bore in the cylinder head and protrudes into the working cylinder of the engine; it does not have to transmit any pumping and clamping forces. However, the disadvantage of this arrangement is that the locational tolerances of the support faces, the laterally disposed injection nozzle and the receiving bore in the cylinder head must be kept extremely tight, to prevent tensing and clamping forces form acting on the injection nozzle. This is critical particularly because the cylinder head is subjected to very large temperature differences, and heat expansion of the cylinder head and pump housing, added to the manufacturing tolerances, results in deviations in the installation location. It is the object of the present invention to intercept the pumping forces in the cylinder head in such a manner that even with severe temperature fluctuations and the existing manufacturing tolerances, no forces that would strain the injection nozzle will be able to act upon it.

OBJECTS AND SUMMARY OF THE INVENTION

It is an object of the pump/nozzle unit according to the invention that the pumping forces resulting from the injection pressure in the pump work chamber are transmitted directly into the cylinder head, without these forces being introduced into the pump housing, by the counterpart piston, which its outwardly pointing end face embodies the support face resting on the support bearing. Thus the injection nozzle, which is attached to the housing extension that protrudes at least approximately at right angles to the longitudinal axis of the pump piston, and the associated receiving bore are entirely relieved from the pumping forces. In the case of the counterpart piston according to FIG. 2, which is fitted, in the form of a floating piston, into a pump cylinder extension which is provided with a constant diameter until the end section of the pump housing, the pumping forces transmitted to the counterpart piston via the fuel, which is under pressure, are introduced entirely into the support bearing. However, it is also possible, by means of slight differences in the diameter of the pump piston and the counterpart piston and correspondingly embodied bores sections in the pump cylinder, to form a pressure shoulder which additionally compensates for drive forces, emanating for instance from the tappet spring.

It is another object of the invention that fuel leakage, which is unavoidable even given close tolerances, is intentionally diverted into a leakage fuel line. The spring element supported on both the counterpart piston and the pump housing in accordance with claim 4 effects a support of the counterpart piston on the support bearing which is always positive and is effective even during the intake stroke of the pump piston, and with its biasing force $F_2$ this spring element compensates for a corresponding mean biasing force $F_1$ of the tappet spring of the injection pump. Thus additional drive forces emanating from the drive mechanism and acting upon the pump housing, although slight in comparison with the pumping forces, are substantially kept from affecting the injection nozzle, and are likewise transmitted via the counterpart piston to the support bearing.

It is still another object of the invention to provide adjustability of the support bearing so that manufacturing tolerances can be compensated for, and both the biasing force $F_2$ and the idle space or the volume of the pump work chamber can be adjusted.

DRAWINGS

Two exemplary embodiments of the pump/nozzle unit according to the invention are shown in the drawings and will be described in further detail below.

FIG. 1, shows the first exemplary embodiment, in terms of a pump/nozzle unit shown partially in longitudinal section and highly simplified, which is built into the cylinder head of the engine; and FIG. 2, shows a longitudinal section taken through the second exemplary embodiment in detailed view.

DESCRIPTION OF THE PREFERRED EMBODIMENTS

Figure 1:
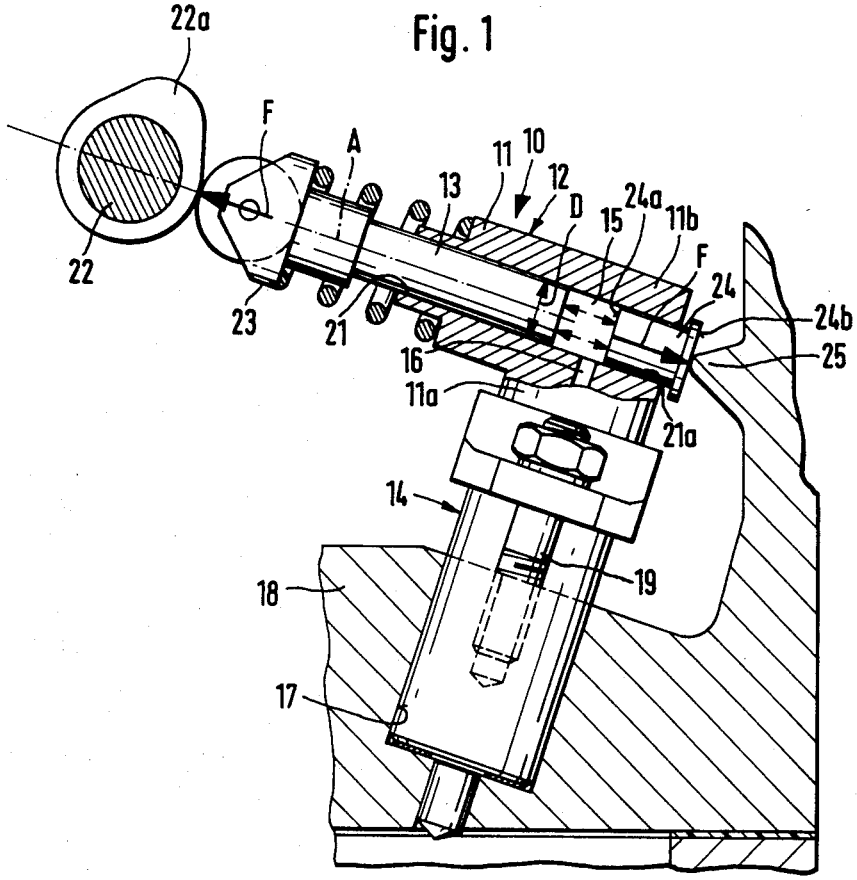

In the highly simplified first exemplary embodiment of the pump/nozzle unit 10 according to the invention, shown in FIG. 1, the pump housing 11 receives a piston injection pump 12 and additionally has an injection nozzle 14, of a known type, disposed at right angles to the longitudinal axis A of a pump piston 13. The injection nozzle 14 is connected to a pump work chamber 15 via a pressure conduit 16 emerging laterally from this pump work chamber 15 and is screwed to an extension **11*a* of the pump housing 11 projecting laterally at least approximately at right angles with respect to the longitudinal axis A of the pump piston 13**.

The injection nozzle 14 is inserted into a receiving bore 17 of a cylinder head 18 of the associated internal combustion engine and is fastened to the cylinder head 18 in a manner known per se via clamping shoes or stay bolts 19. The entire pump/nozzle unit 10 is retained in the cylinder head 18 by means of this fastening, because as a result of the embodiment of the pump/nozzle unit 10 in accordance with the invention, described in detail below, an additional fastening of the injection pump portion is unnecessary.

The pump piston 13, slidably guided in a pump cylinder 21, is actuated in the stroke direction, that is, in the direction of its longitudinal axis A, by a cam 22*a* of an engine camshaft 22, with an interposed tappet 23, and thereby acts upon the pump work chamber 15. This pump work chamber 15, embodied by a section of the pump cylinder 21, is sealed off in a pressure-tight manner from the pump piston 13 on the one hand, and from an inner end face 24*a* of a counterpart piston 24 on the other, by means of an appropriately tight fitting of the associated structural components. An outwardly pointing end face 24*b* of the counterpart piston 24, remote from the inner end face 24*a*, rests on a support bearing 25 as a result of the hydraulic force exerted by the fuel, which is under pressure in the pump work chamber 15, and is therefore subsequently also called the support face 24*b*. The support bearing 25 is an integral component of the cylinder head 18, and all the pumping or reaction force F emanating from the pump piston drive and transmitted via the fuel placed under pressure in the pump work chamber 15 to tthe counterpart piston 24 is absorbed by this support bearing 25, so that the pump housing 11 is substantially relieved. To this end, the counterpart piston 24, embodied as a floating piston, is fitted, in the vicinity of an end section 11*b* of the pump housing 11 remote from the engine camshaft 22, into an extension 21*a* of the pump cylinder 21 which is realized with a constant diameter D as far as this end section 11*b*. The support face 24*b* of the counterpart piston 24 here embodies the most extreme axial extension of the injection pump 12 in the direction of the longitudinal axis A of the pump piston.

The pressure forces transmitted by the drive forces of the pump piston 13 onto the fuel located in the work chamber 15 result, in turn, in the reaction forces or pumping forces F, which act in two directions. Since the radially acting forces cancel one another out, the pump housing 11 is relieved, because of the use of the counterpart piston 24, from the forces acting in the direction of the longitudinal axis A of the pump piston 13 to such a substantial extent that in addition to the already known advantage of the low structural height attained by the angled disposition of the pump/nozzle unit 10, the fastening of the injection nozzle 14 in the cylinder head 18 such that it is insensitive to tolerances and is relieved from the pumping forces comes into play as a particularly prominent advantage of the arrangement according to the invention.

Figure 2:
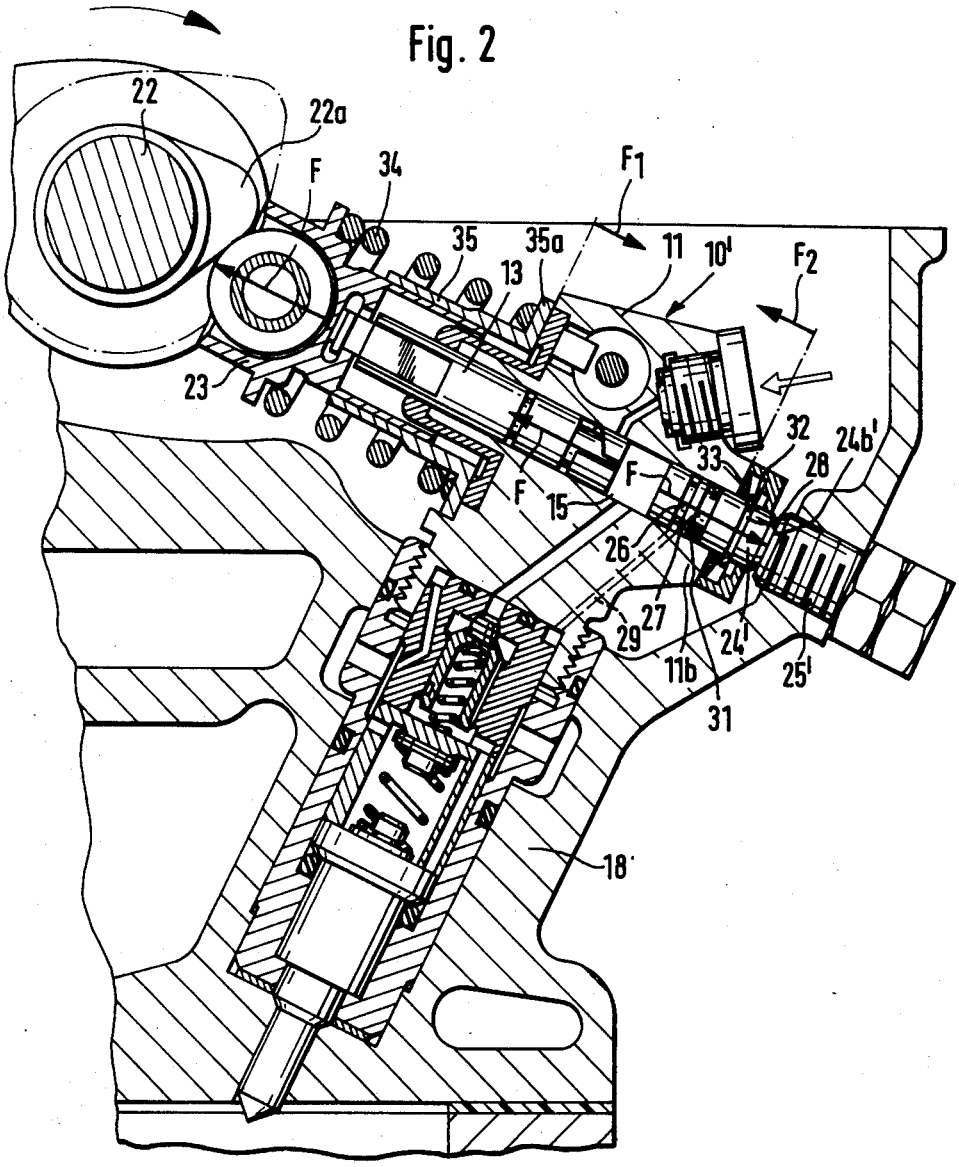

In the second exemplary embodiment shown in FIG. 2 in a longitudinal section with all its structural detail, substantially identical structural parts are identified by the same reference numerals, while differently embodied parts are provided with a prime, and new parts are identified by new reference numerals.

Three annular grooves 26, 27 and 28 disposed in succession are machined into the jacket face of the counterpart piston 24', which is fabricated from a solid cylindrical part having the same diameter and no collar; of these grooves, the one closest to the pump work chamber 15 serves as a leakage fuel return groove 26, communicating with a leakage fuel line 29. The second annular groove 27 receives a sealing ring 31 which prevents the escape to the outside of leakage fuel, and a snap ring 32 which forms a radial protrusion is inserted into the third annular groove 28. The support face 24*b'* formed by the end face of the counterpart piston 24' that points outward is pressed against the support bearing 25' by the biasing force of a spring element 33, which in the present example is embodied by a plate spring, and is thereby supported both on the radial protrusion of the counterpart piston 24' embodied by the snap ring 32 and on the end section 11*b* of the pump housing 11.

The support bearing 25' for the counterpart piston 24' is embodied by a screw part, which is adjustable in order to adjust its installed position and is screwed into the cylinder head 18 of the engine and fastened in a positionally secured manner. Installation tolerances can be compensated for by this means. The installation of the pump/nozzle unit 10' is additionally facilitated if there if a support bearing 25' uncrewed toward the right, and the installed position of the counterpart piston 24' can be adjusted in an infinitely variable manner. It is thereby possible, on the one hand, to compensate for manufacturing tolerances, and on the other hand to vary the biasing force $F_2$ of the plate spring 33 in such a way that it can be made equal to the force designated as $F_1$. $F_1$ is the mean value of the biasing force transmitted during stroke movements of the pump piston 13 by the tappet 23 to a tappet spring 34 and from the tappet spring 24, via a flange 35*a* of a guide sleeve 35 for the tappet 23, to the pump housing 11. The arrows representing the forces $F_1$ and $F_2$ are shown shifted outward, for the sake of clearer illustration. The advantages of the selected structure of the pump/nozzle unit 10', purely in terms of the space the structure requires, are particularly clearly shown in FIG. 2.

What is claimed is:

1. A pump/nozzle unit for fuel injection in internal combustion engines, which comprises a pump housing, a pump cylinder in said pump housing, a pump piston operatively received in said pump cylinder and actuatable via a tappet by an engine camshaft, a support face located beyond said cylinder adjacent an end section of said pump housing remote from the engine camshaft, and supported therein, said support face is embodied by an outwardly pointing end face of a counterpart piston, which is inserted into one end of said pump cylinder in an extension of the longitudinal axis (A) of the pump piston and said counterpart piston includes an inner end face within said cylinder which seals off a pump work chamber in a pressure-tight manner in said cylinder between said pump piston and said support face, said pump work chamber being capable of being acted upon by the pump piston, a housing extension extending laterally approximately at right angles to the longitudinal axis of said pump piston, a passage in said housing extension that extends from said work chamber, at approximately a right angle thereto, and an injection nozzle secured to said housing extension in alignment with said passage in said housing extension.

2. A pump/nozzle unit as defined by claim 1, further characterized in that said counterpart piston is a floating piston and is fitted into an extension of the pump cylinder formed with a constant diameter (D) within said end section of the pump housing.

3. A pump/nozzle unit as defined by claim 2, further characterized in that at least first and second annular grooves are present in the jacket face of the counterpart piston, of which said first annular groove closest to the pump work chamber and serves as a leakage fuel return groove communicating with a leakage fuel line, and the second annular groove receives a sealing ring.

4. A pump/nozzle unit as defined by claim 2, further characterized in that said support face of the counterpart piston is pressed against a support bearing, under the biasing force of a spring element supported on an end section of the pump housing and on a radial protrusion of the counterpart piston.

5. A pump/nozzle unit as defined by claim 1, further characterized in that the support bearing for the counterpart piston is embodied by an adjustable screw part, screwed into a cylinder head of the engine and fastened in a positionally secured manner.

6. A pump/nozzle unit as defined by claim 3, further characterized in that said support face of the counterpart piston is pressed against a support bearing, under the biasing force of a spring element supported on an end section of the pump housing and on a radial of the counterpart piston.

7. A pump/nozzle unit as defined by claim 6, further characterized in that the radial protrusion on the counterpart piston is embodied by a snap ring inserted into a third annular groove.

8. A pump/nozzle unit as defined in claim 1 in which said support face is secured in said pump cylinder by a supporting bearing located on a cylinder head; and said injection nozzle is secured within a receiving bore of said cylinder head.

* * * * *